US009132999B2

(12) United States Patent
Pech et al.

(10) Patent No.: US 9,132,999 B2
(45) Date of Patent: Sep. 15, 2015

(54) METHOD OF CONNECTING CRANE SUSPENSION ASSEMBLY SECTIONS TOGETHER AND FRAME MOUNTED ASSEMBLY USED THEREFORE

(75) Inventors: David J. Pech, Manitowoc, WI (US); Robert J. Walker, Manitowoc, WI (US); William J. O'Neil, Green Bay, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 146 days.

(21) Appl. No.: 13/348,467

(22) Filed: Jan. 11, 2012

(65) Prior Publication Data

US 2012/0175333 A1 Jul. 12, 2012

Related U.S. Application Data

(60) Provisional application No. 61/432,062, filed on Jan. 12, 2011.

(51) Int. Cl.
*B66C 23/26* (2006.01)
*B66C 23/82* (2006.01)

(52) U.S. Cl.
CPC ..... *B66C 23/82* (2013.01); *B66C 23/26* (2013.01); *Y10T 29/49* (2015.01); *Y10T 29/49826* (2015.01)

(58) Field of Classification Search
CPC ..... B66C 23/26; B66C 23/34; B66C 23/344; B66C 23/64; B66C 23/66; B66C 23/68; B66C 23/70; B66C 23/82; B66C 2700/035
USPC ..... 212/175, 176, 177, 347; 52/650.1, 52/651.05, 848
See application file for complete search history.

(56) References Cited

U.S. PATENT DOCUMENTS

| | | | | |
|---|---|---|---|---|
| 2,975,910 | A * | 3/1961 | Conrad | 212/300 |
| 3,977,530 | A * | 8/1976 | Helm et al. | 212/175 |
| 4,421,241 | A * | 12/1983 | Wittman et al. | 212/298 |
| 7,219,810 | B2 * | 5/2007 | Willim | 212/300 |
| 7,565,982 | B2 * | 7/2009 | Kurotsu et al. | 212/298 |
| 2004/0238472 | A1 * | 12/2004 | Varildengen et al. | 212/179 |
| 2010/0072156 | A1 * | 3/2010 | Mentink et al. | 212/196 |
| 2010/0072158 | A1 * | 3/2010 | Wanek | 212/294 |
| 2010/0294735 | A1 * | 11/2010 | Walker et al. | 212/232 |

FOREIGN PATENT DOCUMENTS

| | | | |
|---|---|---|---|
| EP | 2 253 575 | A1 | 11/2010 |
| EP | 2 275 378 | A1 | 1/2011 |

* cited by examiner

*Primary Examiner* — Sang Kim
*Assistant Examiner* — Juan Campos, Jr.
(74) *Attorney, Agent, or Firm* — John C. Bacoch; Brinks Gilson & Lione

(57) ABSTRACT

A method of connecting sections of a crane suspension assembly together includes attaching a frame to a member of a first section; connecting a tension member between the frame and a connector used in the assembly; moving the tension member so that the connector pivots about a pin to a position where a second hole in the connector is in alignment with a hole in a second section member; putting a second pin through the hole in the connector and the hole through the second section member; and disconnecting the tension member from the connector. The method may also include attaching a frame with a winch to a section of the crane suspension assembly; connecting a line from the winch to the connector; activating the winch to move the connector so that it pivots about a pivot axis; and securing the connector in its second position.

24 Claims, 10 Drawing Sheets

FIG. 8
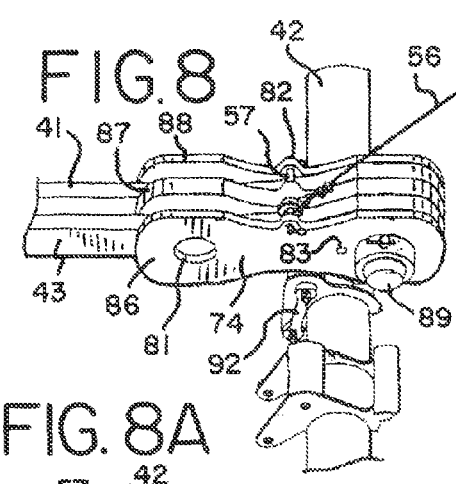
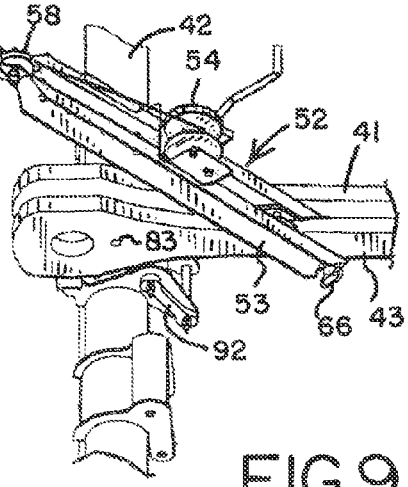
FIG. 8A
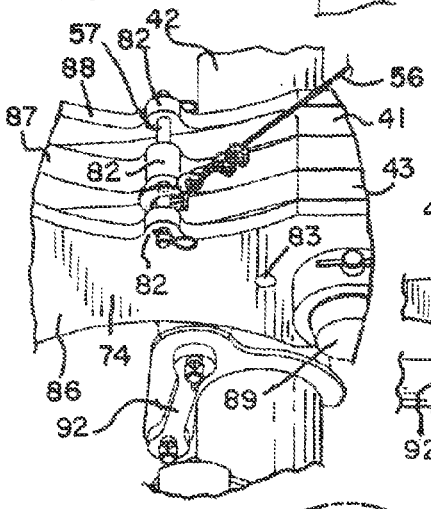
FIG. 9
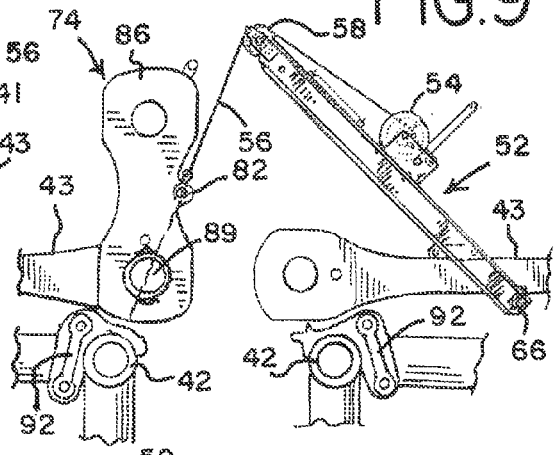
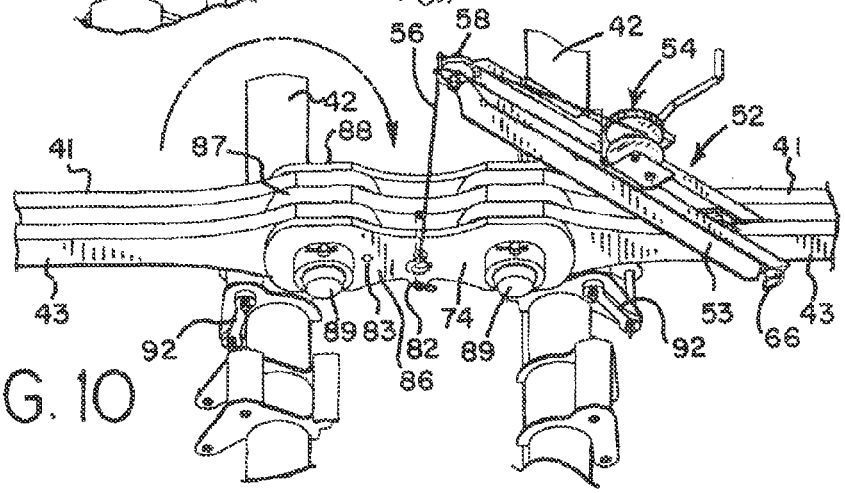
FIG. 10

97
99
19
93
94
82
98
96
91
20
84
89
41
43
95
81
74
86
87
88
85

142
143
144
147
148
151
152
153
159
$\alpha_A$
$\alpha_B$
$\alpha_C$
$h_A$
$h_B$
$h_C$

METHOD OF CONNECTING CRANE SUSPENSION ASSEMBLY SECTIONS TOGETHER AND FRAME MOUNTED ASSEMBLY USED THEREFORE

REFERENCE TO EARLIER FILED APPLICATION

The present application claims the benefit of the filing date under 35 U.S.C. §119(e) of Provisional U.S. patent application Ser. No. 61/432,062, filed Jan. 12, 2011; which is hereby incorporated by reference in its entirety.

BACKGROUND

The present invention relates to methods of connecting suspension assembly members together on a crane, such as mobile lift crane, and a frame mounted assembly used in such methods. Particularly the present invention relates to methods of moving connectors used to connect suspension straps between a stowed position and an operational position.

Lift cranes typically include a carbody; ground engaging members elevating the carbody off the ground; a rotating bed rotatably connected to the carbody such that the rotating bed can swing with respect to the ground engaging members; and a boom pivotally mounted on the rotating bed, with a load hoist line extending there from. For mobile lift cranes, there are different types of moveable ground engaging members, most notably tires for truck mounted cranes, and crawlers. Typically mobile lift cranes include a counterweight to help balance the crane when the crane lifts a load. Typical cranes include a boom suspension that is used to change the angle of the boom and provide tension forces to offset the forces applied to the boom by the load on the load hoist line so that the boom can behave as a column member with only compressive forces acting through the length of the boom. Typical cranes are designed to be set up with different boom length configurations to optimize the capacity that the crane can handle, only using as long of a boom as is necessary for a particular lift operation that the crane is being set up for. Since the boom length will vary between different configurations, the boom suspension also has to be designed to accommodate different boom lengths. Typically the boom suspension includes multiple sections of suspension members that are connected together, sometimes referred to as boom backstay straps, which connect between the top of the boom and either an equalizer suspended between the boom and a fixed mast, or between the boom and the top of a live mast. On a typical crane with a fixed mast, the boom hoist rigging comprises multiple parts of line that run between the equalizer and the top of the mast, and is used to control the angle of the boom.

When the crane needs to work on particularly high buildings or structures, or in restricted spaces, a jib may be mourned at the top of the boom to provide required reach. This could be a fixed jib or a luffing jib. When a jib is employed, one or more jib struts are connected to the top of the boom or bottom of the jib. These struts support the jib rigging and provide a moment arm about which force can be applied to support a load being lifted by the jib. When a luffing jib is used, frequently two struts will be used, and the angle between the struts will be controlled by jib hoist rigging. Changing the angle between the two struts will thus change the angle between the boom and the luffing jib.

When a jib is used on a crane, a jib suspension, typically in the form of backstay straps, is connected between the jib strut and the rotating bed, typically by being connected to the boom butt, which of course is pivotally connected to the rotating bed. These straps, like the straps in the typical boom suspension, are made of several separate sections.

Since the crane will be used in various locations, it needs to be designed so that it can be transported from one job site to the next. This usually requires that the crane be dismantled into components that are of a size and weight that they can be transported by truck within highway transportation limits. The ease with which the crane can be dismantled and set up has an impact on the total cost of using the crane. Thus, to the extent that fewer man-hours are needed to set up the crane, there is a direct advantage to the crane owner or renter.

It is convenient to transport the sections of the boom straps and jib backstay straps with the sections of boom between one job site and the next. This is because, for the most part, the number of sections and the length of each section of the boom straps and the jib backstay straps that will be needed are dependent on the number and lengths of the boom sections that are used to construct the boom. For example, a 100 foot boom may be made from a 10 foot boom butt, a 10 foot boom top and four 20 foot boom inserts. However, if the boom is going to be 120 feet long, five 20 foot boom inserts will be used. If the boom is going to be 130 feet long, five 20 foot inserts and one 10 foot insert will be used. For each of these different boom configurations, different numbers and lengths of sections of the boom straps and jib backstay straps will be used. However, it is convenient if the straps are transported between job sites on the tops of the boom sections where they can be easily connected together to make up the boom straps and jib backstay straps when the sections of boom are put together.

Typically the sections of the boom straps and jib backstay straps are connected together at the job site with connectors. The connectors typically have two holes through them, and the sections of the boom straps and jib backstay straps have a hole on each end. The sections of the boom straps or jib backstay straps are connected to one another by placing a pin though one hole of a connector and the hole in the end of one strap, and another pin through the other hole of the connector and the hole in the end of another section.

It is convenient when disassembling a crane to leave the connectors attached to one of the strap sections, so that the connection between that connector and that strap section does not have to be remade when the crane is assembled again. It is also convenient, when transporting the sections of straps on top of the boom sections, to pivot the connectors 180° from their operational position so that the combined strap section and connector is shorter than if the connector stayed at its operational position. In this position the connector can easily be secured to the strap or the boom section to prevent it from rotating during transport.

When it is time to set up the boom, it is necessary to flip each of the connectors from its stowed position to its operational position. Since each boom section will typically use a suspension where the straps are located on both the left and right sides of the boom, this means that there are two connectors that have to be flipped for every boom section. If the crane will be set up with a jib, there are also two connectors on the jib backstay sections for every boom section. The crane may use other suspension assemblies, such as to support a mast, that will also include multiple sections of suspension assembly, each with a connector between them that needs to be flipped from a stored position to an operation position. Also, typically the connectors are made of multiple link plates so that there are two link plates sandwiching the end of each suspension section.

Thus the crane assembly and disassembly process typically involves, among other things, many repetitive motions of flipping the link plates of the connectors connecting the suspension assemblies on the crane. When the crane is a small size, and the individual connector link plates do not weigh very much, this has not presented much of a problem. However, in larger cranes, each section of the boom suspension may be made of two separate straps, connected together by a connector that has three link plates, and each of these link plates may weigh a hundred pounds or more. Trying to flip the many heavy link plates by hand is not only time consuming, but it may not be safe for an assembly worker to lift more than 50 pounds. Thus it has been typical when setting up or taking apart boom sections for large cranes to use an assist crane to provide the lifting force required to move the connectors between a stowed position and an operational position.

When an assist crane is used, the multiple link plates of each connector can be flipped together. However, the use of an assist crane adds to the expense of setting up and taking down the crane, both because of the rental time for the assist crane and for the salary of the additional assemble person needed to operate the assist crane. Therefore there would be a great benefit if a method were invented of flipping the connector link plates so that the multiple link plates of each connector could be safely flipped at the same time and there was no need for an assist crane and an extra assembly worker. Further, by shortening the amount of time it takes to make each connection between the sections of the crane suspension by even just minutes, the total time for assembling the boom can be shortened by hours, since multiple connections have to be made.

BRIEF SUMMARY

A method of connecting sections of a crane suspension assembly together had been invented that reduces the time it takes to make each connection and does not require the use of an assist crane, even when each connection utilizes connectors weighing hundreds of pounds and containing multiple link plates. A frame mounted assembly has also been invented that is particularly useful in carrying out the method.

In a first aspect, the invention includes a method of connecting first and second sections of a crane suspension assembly together, wherein at least the first section comprises at least one elongated member having a head at an end thereof, the head including a hole there through perpendicular to the axis of elongation of the elongated member; and wherein the second section comprises a member with a hole there through; and further wherein a connector is pivotally connected to the head of the first section elongated member by a first pin extending through a first hole in the connector and the hole in the head of the first section elongated member, the method comprising: attaching a frame to one of the first and second sections; connecting a tension member between the frame and the connector; moving the tension member so that the connector pivots about the first pin from a first position to a second position where a second hole in the connector is in alignment with the hole in the second section member; putting a second pin through the second hole in the connector and the hole through the second section member; and disconnecting the tension member from the connector.

In a second aspect, the invention includes a method of moving a connector used to connect sections of a crane suspension assembly about a pivot axis from a first position to a second position during crane assembly or disassembly comprising: attaching a frame with a winch mounted thereon to a section of the crane suspension assembly; connecting a line from the winch to a lift point on the connector; activating the winch to move the connector so that it pivots about the pivot axis; securing the connector in its second position; and disconnecting the winch line from the connector.

In a third aspect, the invention includes a frame mounted winch assembly for use in assembling and disassembling a connection between first and second sections of a crane suspension assembly comprising: a frame; a winch connected to the frame, the winch comprising a spool; a winch line attached to the spool; and mounting features on the frame that allow the frame to be removably attached at a desired working orientation to one of the sections of the crane suspension assembly.

With the present invention, it is possible for a two man assembly team to make a connection between first and second sections of a boom backstay suspension that involves a connector weighing over 400 pounds and made of three link plates in less than five minutes, compared to about 15 minutes using an assist crane. Thus utilizing the present invention can save hours when assembling or disassembling a typical crane having a boom suspension and a jib suspension with a total of 24 or more individual strap connections. The assembly personnel do not have to lift heavy connectors. These and other advantages of the invention, as well as the invention itself, will be more easily understood in view of the attached drawings.

BRIEF DESCRIPTION OF THE DRAWINGS

FIG. 8 is a partial perspective view of the frame mounted winch assembly of FIG. 7 secured on a backstay strap section positioned on top of a first boom section, with the winch line connected to a connector carried on a backstay strap positioned on top of a second boom section, with the connector in its transport position.

FIG. 8A is an enlarged partial perspective view of the attachment of the winch line to the connector of FIG. 8.

FIG. 9 is a side elevational view like that of FIG. 8 but with the connector in an intermediate position.

FIG. 10 is a partial perspective view like that of FIG. 8 but with the connector flipped to its operational position and secured with a pin to the backstay strap section on which the frame is mounted.

DETAILED DESCRIPTION OF THE DRAWINGS AND THE PRESENTLY PREFERRED EMBODIMENTS

Figure 1:
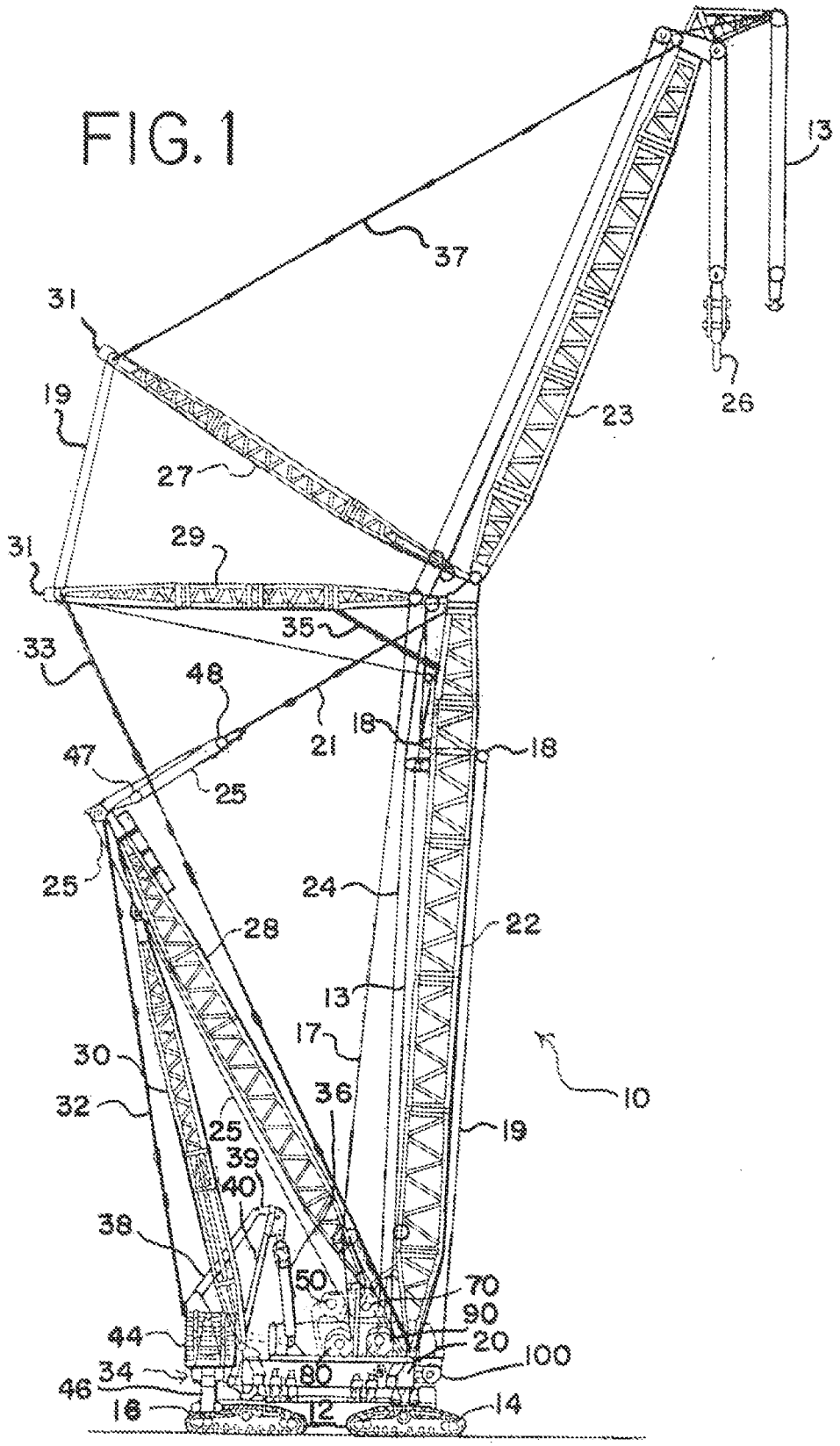
FIG. 1 is a side elevational view of a mobile lift crane to which the present invention can be applied.

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

The preferred embodiment of the present invention relates to a high capacity mobile lift crane, other aspects of which are disclosed in U.S. Pat. No. 7,546,928 (Mobile Lift Crane With Variable Position Counterweight), U.S. Pat. No. 7,762,412 (Mast Raising Structure And Process For High-Capacity Mobile Lift Crane), U.S. Pat. No. 7,946,560 (Crane Hook Block), U.S. Pat. No. 7,954,657 (Connection System For Crane Boom Segments), U.S. Pat. No. 7,967,158 (Mobile Lift Crane With Variable Position Counterweight) U.S. Pat. No. 7,997,432 (Trunnion Transportation System And Crane Using Same) and U.S. Pat. No. 8,075,069 (Drive Tumbler And Track Drive For Mobile Vehicles, Including Lift Cranes), and the following co-pending United States patent applications assigned to the assignee of the present application: "Track Connection System For Mobile Vehicles, Including Lift Cranes," Ser. No. 12/368,125, filed Feb. 9, 2009; "Track Tensioning System For Mobile Vehicles, Including Lift Cranes," Ser. No. 12/368,113, filed Feb. 9, 2009; "Boom Hoist Transportation System And Crane Using Same," Ser. No. 12/561,007, filed Sep. 16, 2009; Carbody Connection System And Crane Using Same," Ser. No. 12/561,103, filed Sep. 16, 2009; "Drum Frame System For Cranes," Ser. No. 12/561,094, filed Sep. 16, 2009; Swing Drive System For Cranes," Ser. No. 12/710,960, filed Feb. 23, 2010; "Counterweight Block And Assemblies For Cranes," Ser. No. 12/718,156, filed Mar. 5, 2010; "Folding Jib Main Strut And Transportable Reeved Strut Caps," Ser. No. 12/730,421, filed Mar. 24, 2010; "Compressible Stop Member For Use On A Crane," Ser. No. 12/781,739, filed May 17, 2010, "Crane Backstay Spreader," Ser. No. 12/777,094, filed May 10, 2010, and "Pinned Connection System For Crane Column Segments," Ser. No. 13/236,307, filed Sep. 19, 2011. Each of these patents and applications is hereby incorporated by reference.

The following terms used in the specification and claims have a meaning defined as follows.

The term "crane suspension assembly section" refers to sections that are connected together to form a suspension assembly for a crane. Examples of crane suspension assembly sections include a) sections, sometimes called strap sections, of the backstay between the boom top and the equalizer or live mast; b) sections of the backstay between a boom butt and a jib strut; c) sections of the backstay between a jib strut and a jib top, and d) counterweight strap sections between a mast top and a counterweight. Besides strap sections, which are traditionally elongated rigid metal members with a head on each end with a hole there through, sometimes wire rope pendants or even carbon fiber tension members are used to create the longitudinal part of the crane suspension assembly, and are therefore crane suspension assembly sections. The sections may be made of multiple parallel elongated members, as in the preferred strap sections shown in FIG. 4. The term "crane suspension assembly section" also includes the equalizer and the boom top, since these are parts of the boom suspension assembly and are connected to boom backstay straps. "Crane suspension assembly section" also includes other members attached to strap sections, such as the boom butt, the mast top, the jib top, jib strut tops and live mast top, and intermediate suspension members.

The term "pin" refers to a generally cylindrical member that allows pivotal rotation between two or more structures that have a hole through them and are connected together by the pin fitting through the holes. A pin may include a head or retainer, such as a cotter pin, on one or both ends to prevent the pin from sliding longitudinally through the holes. While most pins used in the present invention will have smooth shafts, a bolt with a threaded shaft may be used as a pin in some instances, and is such usages is therefore within the meaning of the term "pin."

The term "connector" refers to the structure used to hold an elongated section of the crane suspension assembly to other sections of the assembly. Typically connectors have two holes through them so that they can be attached, with a pin through each hole, between two adjoining straps in the crane suspension assembly. A connector may have only one link plate. More typically the connector is made of multiple link plates so that it can sandwich the head of the strap section between the link plates and thus transfer tension loads equally through the two link plates without inducing bending moments through the 2.5 connector/strap section joint. When the sections to which the connectors are attached are made of multiple parallel elongated members, the connectors will often include a number of link plates one greater than the number of elongated members. For example, when the sections of the crane suspension system are made of two elongated members, the connector will be made with three link plates.

The connectors in the present invention are lifted, and thus will typically include a lift point on the connector. The term "lift point" refers to the structure on the connector that is used to attach the line or other tension member used to lift the connector. When connectors include multiple link plates, the link plates may be held together by a bar so that the link plates can all be lifted simultaneously. If the bar is used to connect a winch line hook to the multiple link plates of the connector, the lift point of the connector will be the point about which all of the lifting forces applied to the various pieces of the connector have the same lifting effect as if they were all applied at that one point to a rigid body having the shape of the spaced apart plates. Also, if the winch line 56 forked and included two hooks that attached to the connector 74 or bar 57 at multiple positions, the term "lift point" is understood to be the point at which the same lifting effect would be achieved if the lift forces were all applied at that one point.

The term "center of gravity of the connector is approximately directly above the first pin" means that the center of gravity is within five degrees of a vertical line though the axis of rotation of the pin.

The term "center of gravity of the connector is directly above the first pin" means that the center of gravity is within one degree of a vertical line though the axis of rotation of the pin.

While the invention will have applicability to many types of cranes, it will be described in connection with mobile lift crane 10, shown in an operational configuration in FIGS. 1-2. The mobile lift crane 10 includes lower works, also referred to as a carbody 12, and moveable ground engaging members in the form of crawlers 14 and 16. There are of course two front crawlers 14 and two rear crawlers 16. In the crane 10, the ground engaging members could be just one set of crawlers, one crawler on each side. Of course additional crawlers than those shown can be used, as well as other types of ground engaging members, such as tires.

The rotating bed 20 is mounted to the carbody 12 with a slowing ring, such that the rotating bed 20 can swing about an axis with respect to the ground engaging members 14, 16. The rotating bed supports a boom 22 pivotally mounted on a front portion of the rotating bed; a mast 28 mounted at its first end on the rotating bed, with a lower equalizer 47 connected to the mast adjacent the second end of the mast; a backhitch 30 connected between the mast and a rear portion of the rotating bed; and a moveable counterweight unit 34. The counterweight may be in the form of multiple stacks of individual counterweight members 44 on a support member.

Boom hoist rigging (described in more detail below) between the top of mast 28 and boom 22 is used to control the boom angle and transfer load so that the counterweight can be used to balance a load lifted by the crane. A load hoist line 24 is trained over a pulley on the boom 22, supporting a hook 26. At the other end, the load hoist line is wound on a first main load hoist drum 70 connected to the rotating bed, described in more detail below. The rotating bed 20 includes other elements commonly found on a mobile lift crane, such as an operator's cab, hoist drum 50 for the boom hoist rigging, a second main hoist drum 80 and an auxiliary load hoist drum 90 for a whip line.

Figure 2:
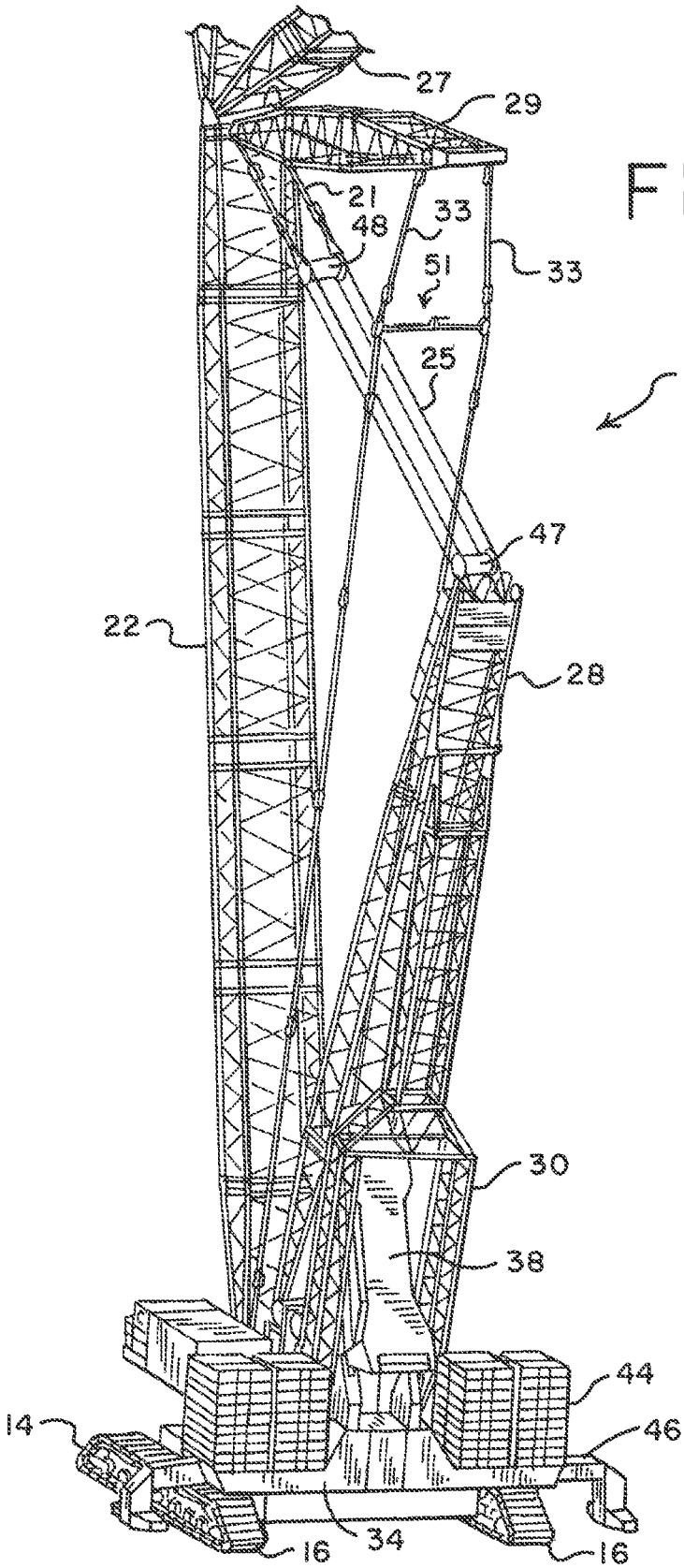
FIG. 2 is a rear perspective view of the crane of FIG. 1 with some components removed for sake of clarity but showing the jib and boom backstays.

As shown in FIG. 1, the boom 22 includes a jib 23, preferably a luffing jib pivotally mounted to the top of the main boom 22. The crane also includes jib strut 27 and main strut 29, as well as associated luffing jib rigging and a luffing jib hoist drum 100. A luffing jib hoist line 19 runs from the drum 100, through one or more wire guides 18, and up to the rigging between sheaves in strut caps 31, and is used to control the angle between jib strut 27 and main strut 29.

Two jib backstay straps 33 are connected between the end of the main strut 29, e.g., to or near the cap thereof, and the bottom of the boom 22. Since the boom 22 is connected to the rotating bed 20, the jib backstay straps 33 are connected to the rotating bed 20 though being connected to the boom 22. These jib backstay straps are made of multiple fixed-length sections. Selection of the number of sections and the length of each section allows changing the length of the longest side of the fixed-angle triangle formed between the main strut 29 and the boom 22 to accommodate different boom lengths. By changing the length of the jib backstay straps 33, a constant angle may be maintained between the main strut 29 and the boom 22 for each length of the boom for which the crane is designed. An adjustable length spreader 51 (FIG. 2) is connected between the pair of jib backstay straps 33, the spreader preferably including a hydraulic cylinder actuatable to spread the jib backstay straps apart at the place of connection of the spreader further than the jib backstay straps would be spread without the spreader.

Sections of jib support straps 37 may be connected between the end of the jib strut 27 and adjacent the top of the luffing jib 23 to maintain a constant angle there between. Thus, the angle between the main strut 29 and jib strut 27 also defines the angle that the luffing jib 23 makes with the main boom 22. By using the jib support straps 37 as described, panning out or retracting the luffing jib hoist line 19 allows expanding or retracting the angle between the main and jib struts 27, 29. A strut stop 35 is connected between the main strut 29 and the boom 22 to provide support to the main strut 29 if no load is on the jib and the forces pulling the main strut up are less than the forces pulling the main strut down. Details of how the struts, jib hoist rigging and jib backstay straps 33 are assembled are more fully disclosed in U.S. patent application Ser. No. 12/730,421.

The backhitch 30 is connected adjacent the top of the mast 28, but down the mast far enough that it does not interfere with other items connected to the mast. The backhitch 30 may comprise a lattice member, as shown in FIG. 1, designed to carry both compression and tension loads. In the crane 10, the mast is held at a fixed angle with respect to the rotating bed during crane operations, such as a pick, move and set operation.

The counterweight unit 34 is moveable with respect to the rest of the rotating bed 20. A tension member 32 connected adjacent the top of the mast supports the counterweight unit in a suspended mode. A counterweight movement structure is connected between the rotating bed and the counterweight unit such that the counterweight unit may be moved to and held at a first position in front of the top of the mast, and moved to and held at a second position rearward of the top of the mast, described more fully in the U.S. Pat. No. 7,967,158.

At least one linear actuation device 36, such as a hydraulic cylinder, or alternatively a rack and pinion assembly, and at least one arm pivotally connected at a first end to the rotating bed and at a second end to the a linear actuation device 36, are used in the counterweight movement structure of crane 10 to change the position of the counterweight. The arm and linear actuation device 36 are connected between the rotating bed and the counterweight unit such that extension and retraction of the linear actuation device 36 changes the position of the counterweight unit compared to the rotating bed. While FIGS. 1-2 show the counterweight unit in its most forward position, the linear actuation device 36 can be partially or fully extended, which moves the counterweight unit to mid and aft positions, or any intermediate position, such as when a load is suspended from the hook 26.

In the preferred embodiment of the counterweight movement structure, a pivot frame 40, which may be a solid welded plate structure, is connected between the rotating bed 20 and the second end of the linear actuation device 36. The rear arm 38 is connected between the pivot frame 40 and the counterweight unit. The rear arm 38 is also a welded plate structure with an angled portion 39 at the end that connects to the pivot frame 40. This allows the arm 38 to connect directly in line with the pivot frame 40. As best seen in FIG. 2, the backhitch 30 has an A-shape configuration, with spread-apart lower legs, which allows the counterweight movement structure to pass between the legs when needed.

The crane 10 may be equipped with a counterweight support system 46, which may be required to comply with crane regulations in some countries. The counterweight movement structure and counterweight support structure are more fully disclosed in U.S. Pat. No. 7,967,158.

The boom hoist rigging includes a boom hoist line in the form of wire rope 25 wound on a boom hoist drum 50, and reeved through sheaves on a lower equalizer 47 and an upper equalizer 48. The rigging also includes fixed length straps 21 connected between the boom top and the upper equalizer 48. The lower equalizer 47 is connected to the rotating bed 20 though the mast 28. This arrangement allows rotation of the boom hoist drum 50 to change the amount of boom hoist line 25 between the lower equalizer 47 and the upper equalizer 48, thereby changing the angle between the rotating bed 20 and the boom 22.

Crane 10 includes four drums each mounted in a frame and connected to the rotating bed in a stacked configuration. (The rotating bed includes a main frame and front and rear roller carriers.) In addition, the jib hoist drum 100 is mounted in a frame attached to the front surface of the front roller carrier. Frames of two of the four stacked drums are connected directly to the rotating bed, while the frames of the other two drums are indirectly connected to the rotating bed by being directly connected to at least one of the two drum frames connected directly to the rotating bed. In this case, the four stacked drums are preferably the first main load hoist drum 70 with load hoist line 24 wound thereon, the second main load hoist drum 80 with load hoist line 17 wound thereon, the auxiliary load hoist drum 90 with whip line 13 wound thereon, and the boom hoist drum 50 with boom hoist line 25 wound thereon.

Figures 4, 5:
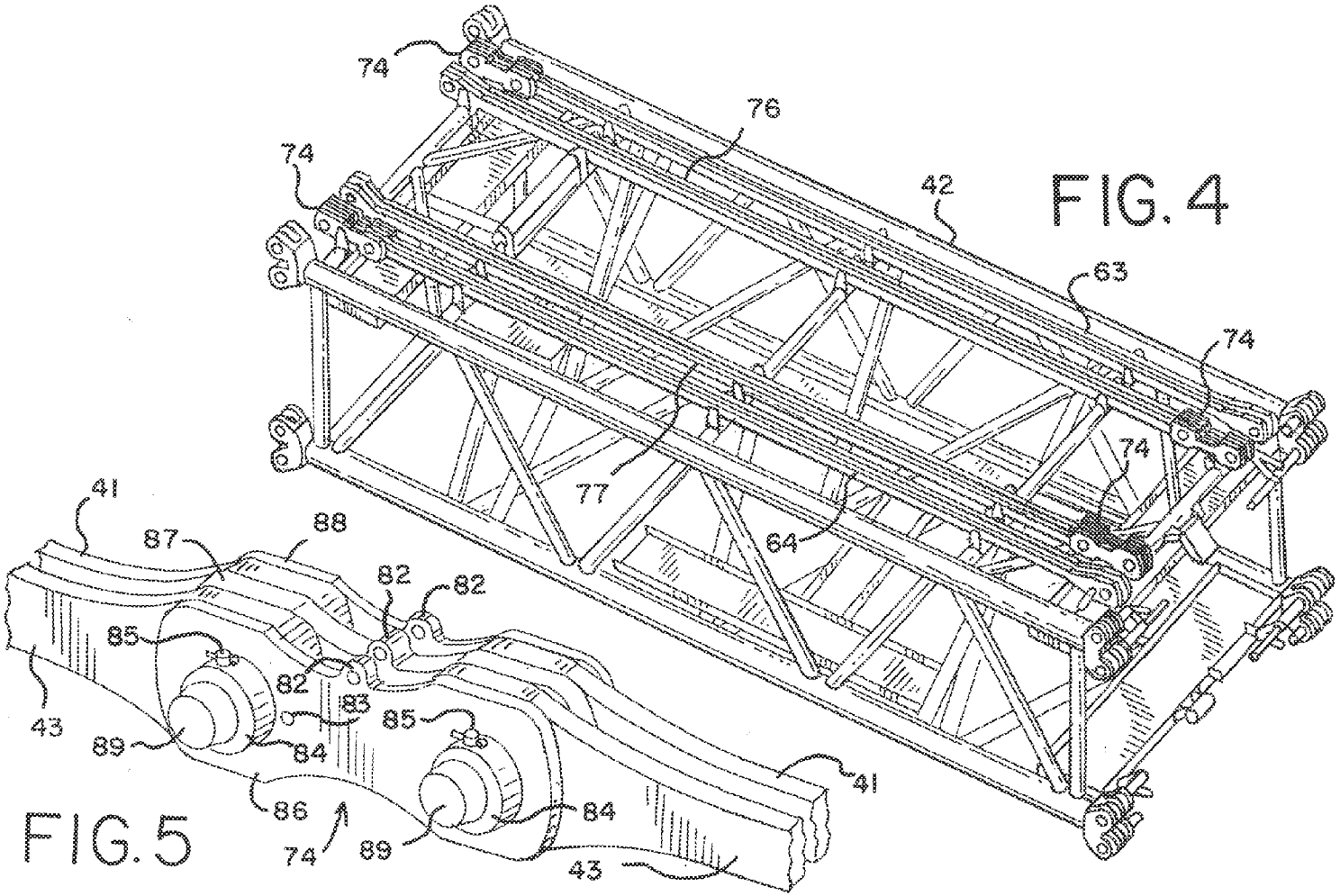
FIG. 4 is a perspective view of a boom section used to construct the crane of FIG. 1, with sections of boom straps and jib backstay straps attached, in a transport mode.
FIG. 5 is a detailed view of the longitudinal connection between two sections of backstay straps used in the crane of FIG. 1.

As discussed above, the boom 22 is made by connecting multiple boom sections together, the jib backstay straps 33 are each made by connecting multiple backstay strap sections together, and the boom is supported during crane operation by a pair of boom straps 21 each made from sections. As best shown in FIG. 4, two jib backstay strap sections 63, 64 are transported to a job site prior to crane setup while mounted in a parallel fashion on a boom section 42 with a width between them. Two boom strap sections 76, 77 are also transported mounted in a parallel fashion on the boom section 42 with a width between them, the boom strap sections 76, 77 being mounted on the boom section 42 in between the jib backstay strap sections 63, 64. Preferably the boom strap sections 76 and 77 are transported at a width that corresponds to the width they will be at when attached between the top of the boom 22 and the second equalizer 48, and the jib backstay strap sections 63 and 64 are transported at a width that corresponds to the width they will be at when attached at the boom butt and to the end of the main strut 29.

Preferably each of the jib backstay strap sections 63 and 64 comprise double elongated members, and the backstay strap sections include connectors 74 on one end when being transported that will allow them to be connected to another jib backstay strap section. FIG. 5 shows a preferred connection made between sections of backstay straps (either the boom backstay straps or the jib backstay straps). As noted, each section is made of double elongated members 41 and 43. These elongated members comprise a widened head portion on their ends, with a hole through the widened portion. The connector 74 includes three link plates 86, 87 and 88, each having widened portions at both ends with a hole through each of the widened ends. Link plate 87 is placed between elongated members 41 and 43, and link plates 86 and 88 are placed on the outsides of elongated members 41 and 43, sandwiching the ends of the elongated members 41 and 43 and the link plate 87 between them. Pins 89 are secured through the holes in the elongated members and link plates to allow the link plates to hold the end of one section of the backstay strap to another section of the backstay strap.

When the jib backstay sections 63, 64 and boom strap sections 76, 77 are transported on top of the boom section 42, the connector 74 is attached to one end of the strap section with one pin 89, as shown in FIG. 4, and the second pin 89 is transported with the end of the section to which the connector will later be connected. To shorten the length of the combined strap section and connector 74, the link plates 86, 87 and 88 are folded back 180'. The center link plate 87 fits between the elongated members 41 and 43, and the outer link plates 86 and 88 lay alongside the elongated members 41 and 43. When two backstay sections are to be coupled together during crane set-up, the link plates 86, 87 and 88 are folded back out to their extended position (described in more detail below), the elongated members 41 and 43 from the second section are placed in between the link plates 86, 87 and 88 with their holes lined up so that the second pin 89 can be inserted and secured.

As seen in FIG. 8, a small hole 83 is provided in the link plates and ends of the elongated members 41 and 43. A pin is placed through this small hole and through a short strap 92. The other end of strap 92 is pinned to the boom section 42. Thus the short strap 92 and small pin through small hole 83 are used to hold the link plates together and to the elongated members in their transport configuration. The strap 92 is later rotated to the position shown in FIG. 8 when the connections are made between the strap sections during the boom assembly process.

Figure 3:
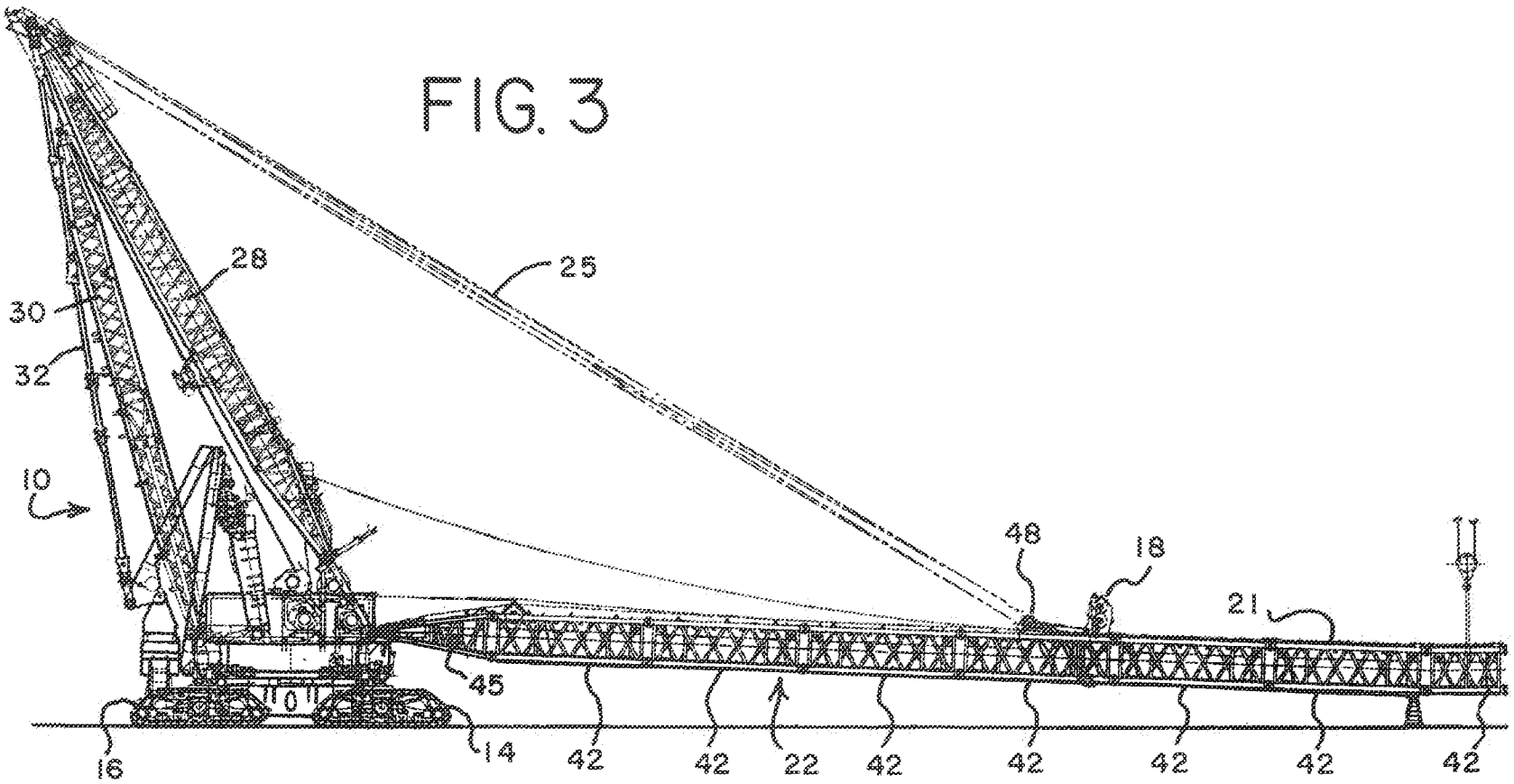
FIG. 3 is a side elevational view of the mobile lift of FIG. 1 during the boom set-up operation.

When setting up the crane 10, first the boom 22 is pivotally connected to the rotating bed 20. This begins with off-loading and staging the boom butt 45 and the first boom segment 42 and pinning them together. This entire arrangement is then assembled into the boom hinge on the rotating bed and pinned. Additional boom segments and the boom top are added to reach the desired boom length. FIG. 3 show the crane 10 with the boom butt 45 and six boom sections 42 already in place, with a seventh boom section 42, suspended by an assist crane, being attached. The preferred connection system between boom sections 42 is described in U.S. Pat. No. 7,954,657. The upper equalizer 48 is brought into place and pinned temporarily to the boom, as shown in FIG. 3 and as described in more detail in U.S. patent application Ser. No. 12/561,007. The fixed length pendants 21 can then be connected to the upper equalizer 48 as explained in more detail below, thus connecting the upper equalizer to the boom top.

The first and second jib struts 27 and 29, as well as associated luffing jib rigging, are installed next. The end sections of jib backstay straps 33 are attached to the main strut 29 and the bottom of boom 22, and additional sections are connected to one another as described in detail below. However, the final connection between the sections making up each jib backstay strap 33 is made as the main strut 29 is raised into position, as described in U.S. patent application Ser. No. 12/730,421.

Figures 11, 12, 13, 14, 15:
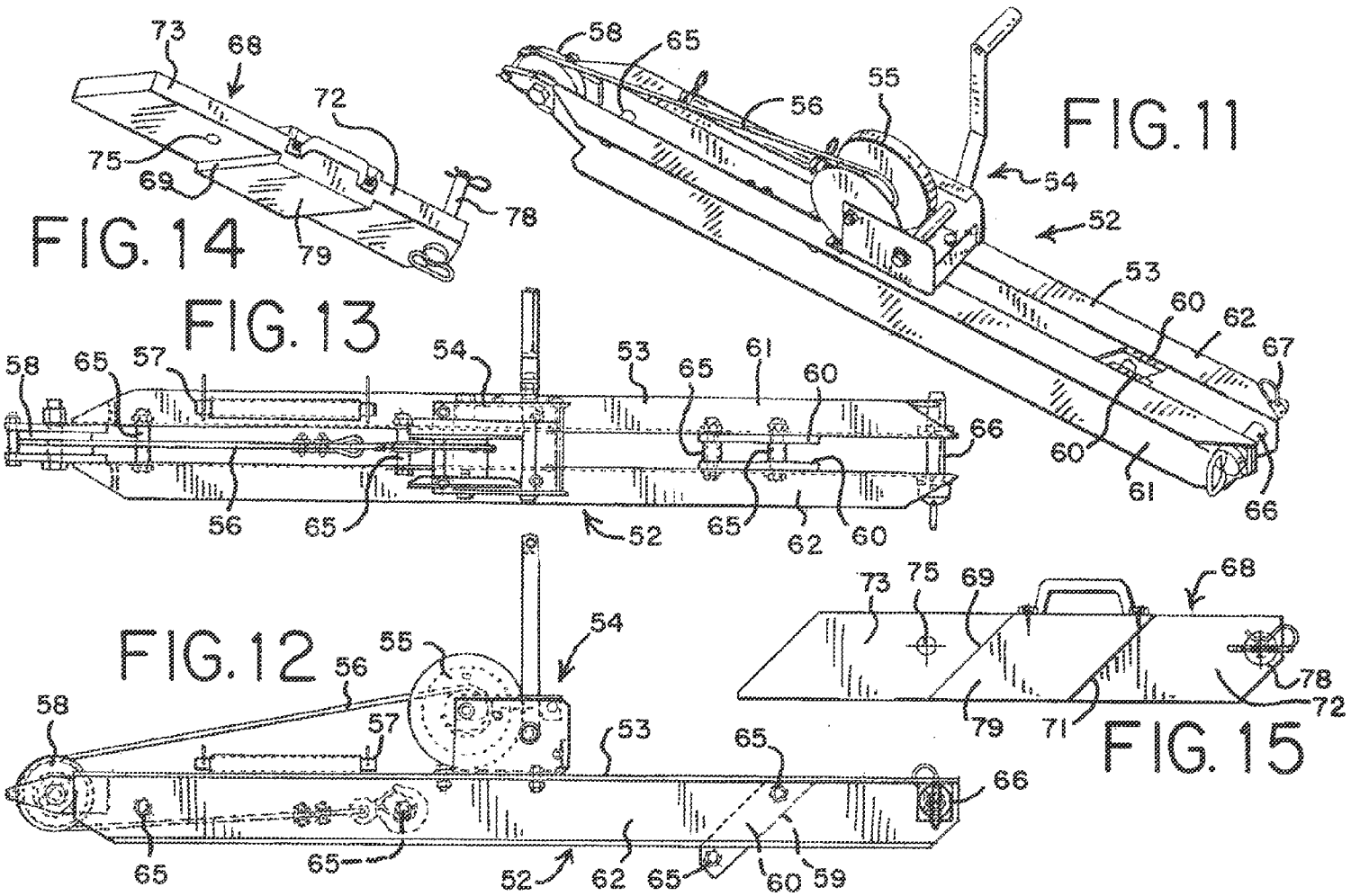
FIG. 11 is a perspective view of the frame mounted winch assembly used in FIGS. 7-10.
FIG. 12 is a side elevational view of the frame mounted winch assembly of FIG. 11.
FIG. 13 is a top plan view of the frame mounted winch assembly of FIG. 11.
FIG. 14 is a perspective view of the frame extension used in FIG. 7.
FIG. 15 is a side devotional view of the frame extension of FIG. 14.

FIGS. 11-13 show a preferred frame mounted assembly 52 for use in assembling and disassembling a connection between first and second sections of a crane suspension assembly, such as the boom suspension, in which boom backstay strap sections are connected, and the luffing jib suspension, in which jib backstay strap sections are connected. The frame mounted assembly 52 includes a frame 53; a winch 54 connected to the frame, the winch comprising a spool 55; a winch line 56 attached to the spool 55; and mounting features on the frame 53 that allow the frame to be removably attached at a desired working orientation to one of the sections of the crane suspension assembly. The preferred frame mounted assembly 52 also includes a pulley 58 supported on the frame, with the winch line 56 trained over the pulley.

The frame 53 comprises two spaced apart side frame plates 61 and 62. The mounting features include a support surface 59 (FIG. 12) attached to at least one of the plates and located between the plates such that the frame 53 may be attached to the a section of the crane suspension assembly, such as elongated member 43 as shown in FIGS. 8-10, by placing the frame over the section of the crane suspension assembly with the support surface 59 resting on the section of the crane suspension assembly, with the two spaced side frame plates 61 and 62 on either side of the section of the crane suspension assembly. In the embodiment of frame assembly 52, the support surface 59 is provided by two plates 60, one of which is welded onto each of plates 61 and 62 (FIGS. 11 and 13) at an angle (FIG. 12) so that the support surface 59 will have a flat contact against the section of the crane suspension assembly when the frame is mounted in its operational orientation. Spacers 65 are placed between the plates 60, and between side frame plates 61 and 62 near pulley 58, to keep the side frame plates 61 and 62 spaced apart.

The mounting features also include a lower engagement surface that secures the frame 53 to the section of the crane suspension assembly, by holding the frame onto the elongated member 43 from the bottom. This lower engagement surface cooperates with the support surface 59, preventing the frame 53 from rotating about the support surface 59 when a load is applied to the pulley 58. Preferably this lower engagement surface is provided by a shaft that can be removably attached between the two spaced side frame plates 61 and 62 below the second section of the crane suspension assembly. Preferably this shaft is in the form of a hitch pin 66. As seen in FIGS. 8-10, the hitch pin 66 is inserted through a hole in each of side frame plates 61 and 62 below the elongated member 43 after the side frame plates 61 and 62 are placed over the elongated member 43, and then held in place by a retaining pin 67 while the frame assembly 52 is in use.

The frame assembly 52 may include other features, such as a holder on the frame designed to hold a bar 57 that is used to attach the winch line 56 to a connector 74. Also, as seen in FIG. 12, another spacer 65 in the central portion of the frame 53 may be used as a stowage place to attach a hook on the end of winch line 56 when not in use.

FIGS. 8-10 show the steps of using the frame assembly 52 to flip the link plates 86, 87, 88 of a connector 74 while connecting first and second sections of a crane suspension assembly together. As described earlier in reference to FIGS. 4 and 5, at least the first section has at least one elongated member 43 having a head at an end thereof, the head including a hole there through perpendicular to the axis of elongation of the elongated member 43. The second section, in this case another elongated member 43, also has a hole there through. Also, in this embodiment, both the first and second sections of the crane suspension assembly each comprise a plurality of elongated members, in that both of the sections comprise two elongated members, 41 and 43, in parallel. The connector 74 is pivotally connected to the head of the first section elongated members 41 and 43 by a first pin 89 extending through a first hole in the connector 74 and the holes in the heads of the first section elongated members. The basic method first involves attaching the frame 53 to one of the first and second sections. In this case the frame is attached to the second section elongated member 43. Second, a tension member (in this case flexible winch line 56) is connected between the frame 53 and the connector 74. Third, the tension member is moved (in this case by winding the line 56 onto and off of the winch 54) so that the connector 74 pivots about the first pin 89 from a first position (FIG. 8) to a second position (FIG. 10) where a second hole 81 in the connector 74 is in alignment with the hole in the second section member 43. Preferably this third step involves pivoting the connector 74 and thereby raising its center of gravity to a position (FIG. 9) where its center of gravity is approximately directly above the first pin 89, moving the connector 74 to where gravity causes the connector 74 to want to fall to its second position, and moving the tension member in a controlled manner to lower the connector 74 to the second position. Fourth, a second pin 89 is placed through the second hole 81 in the connector 74 and the hole through the second section member. Fifth, the tension member is disconnected from the connector 74.

Stated another way, the method involves moving a connector 74 used to connect sections of a crane suspension assembly about a pivot axis from a first position to a second position during crane assembly or disassembly, and includes the following steps: attaching a frame 53 with a winch 54 mounted thereon to a section 43 of the crane suspension assembly; connecting a line 56 from the winch 54 to a lift point on the connector; activating the winch 54 to move the connector 74 so that it pivots about the pivot axis; securing the connector in its second position; and disconnecting the winch line 56 from the connector 74. In this regard, the step of activating the winch 54 to move the connector 74 preferably involves pivoting the connector 74 about a first pin 89 defining the pivot axis and thereby raising the center of gravity of the connector 74 to a position where the center of gravity is approximately directly above the first pin; then moving the connector 74 further to where gravity causes the connector to want to fall to its second position; and then letting the line out from the winch in a controlled manner to lower the connector 74 to the second position. The winch may be used to hold the connector 74 in the second position while the second pin 89 is inserted. Alternatively, the boom insert 42 may be constructed with a landing at the correct position so that as the link plates 86, 87, 88 are flipped over, they come to rest on the landing so that the holes 81 in the link plates are aligned with the holes in the heads of the elongated members 41 and 43.

As shown in FIG. 8, the winch line 56 includes a hook, and the link plates 86, 87, 88 of the connector 74 each include an ear 82 with a hole there through The lift point on the connector may thus be provided by passing bar 57 through holes in ears 82 on each of the link plates. Then the hook is attached to the bar 57 to move the connector link plates simultaneously.

The positioning of the frame assembly 52 on elongated member 41 will dictate the relative position between the tangent of the pulley 58 where the line 56 leaves the pulley and the lift point on the connector 74, which in turn will determine the travel of the lift point in an arc relative to the position of the pulley. Preferably when assembling the crane 10, the frame assembly 52 will be connected to the elongated member 43 of the section of suspension that the connector 74 is being flipped over to, as shown in FIG. 8. Also, preferably the frame 53 is attached to the section of the crane suspension assembly at a point such that the line of action of the winch line 56 is through the lift point and the pivot axis when the center of gravity of the connector 74 is directly above the first pin 89. FIG. 9 shows the connector 74 in this position, and it can be seen that the line of action from the pulley tangent through the lift point at ears 82 continues on to intersect the axis of rotation of pin 89. When the line of action of the winch line 56 intersects the pivot axis, the winch line 56 is must fully wound onto the spool 55, and further travel of the connector 74 will require the winch line to be wound off of the spool so that the lift point can continue in a downward arc. Positioning the frame 53 relative to the connector 74 at this preferred position allows the frame assembly 52 to be used to lift the connector 74 to an upright position while either assembling or disassembling the suspension. Of course if there is not sufficient momentum when the connector 74 reaches the upright position, one of the assembly workers may need to provide a slight push to get the connector 74 to go in the right direction as the winch line 56 is let out. Gravity will then pull the connector 74 to its second position where it can be pinned.

In some instances the workers assembling the crane may position the frame 53 slightly further back from the connector 74 than the ideal position described above. In that case, when the line of action of the winch line is through the lift point and the pivot axis, the center of gravity of the connector will be in a position such that the weight of the connector can produce sufficient moment to overcome frictional forces in the pivot axis and allow the connector 74 to travel to its second position without a push from the worker. However, if the frame 53 is set back to far on elongated member 43, and the line of action of the winch line is not through the pivot axis when the center of gravity of the connector is directly above the pivot axis, the connector 74 will tend to fall and put a shock load on the winch line, because the length of the winch line will be longer than needed when the connector 74 is upright. As long as this shock load is small compared to the strength of the winch line 56, this will not be a problem. However, when disassembling the crane, if the frame 53 is placed too far back on the elongated member 43, the winch line will be fully drawn in as far as it can be when the line of action is through the pivot axis, but the center of gravity of the connector will not be directly above the pivot axis, requiring greater effort by the assembly worker to push the connector 74 over to where it can fall back to its transport position.

Figure 6:
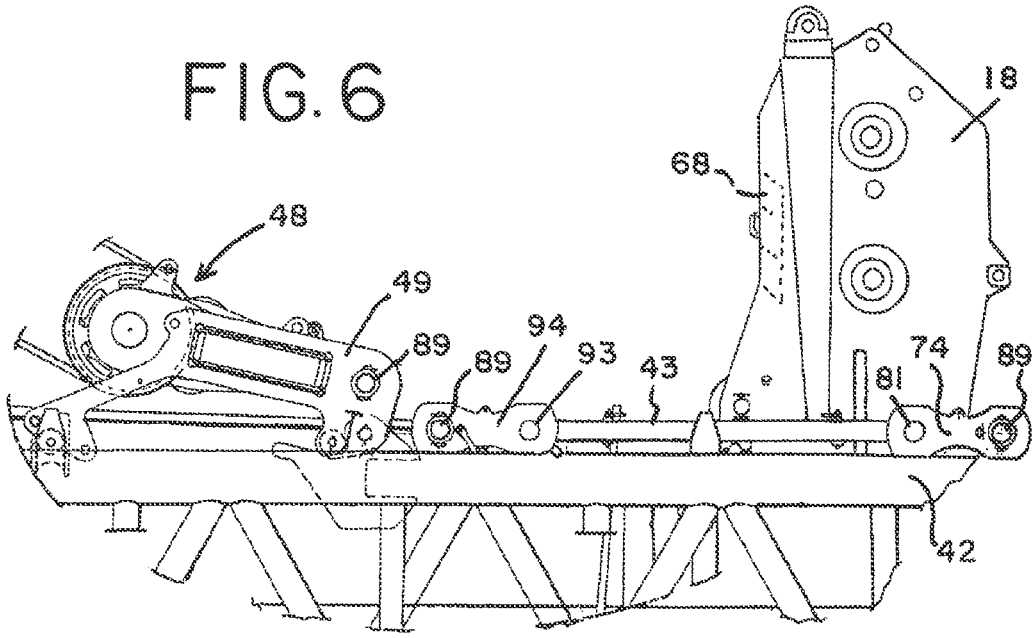
FIG. 6 is side elevational view of a part of the boom of the crane of FIG. 1 showing the equalizer connected to the boom as part of the set-up operation, with the boom backstay section and connector that connects to the equalizer shown in their set-up configuration.
Figure 7:
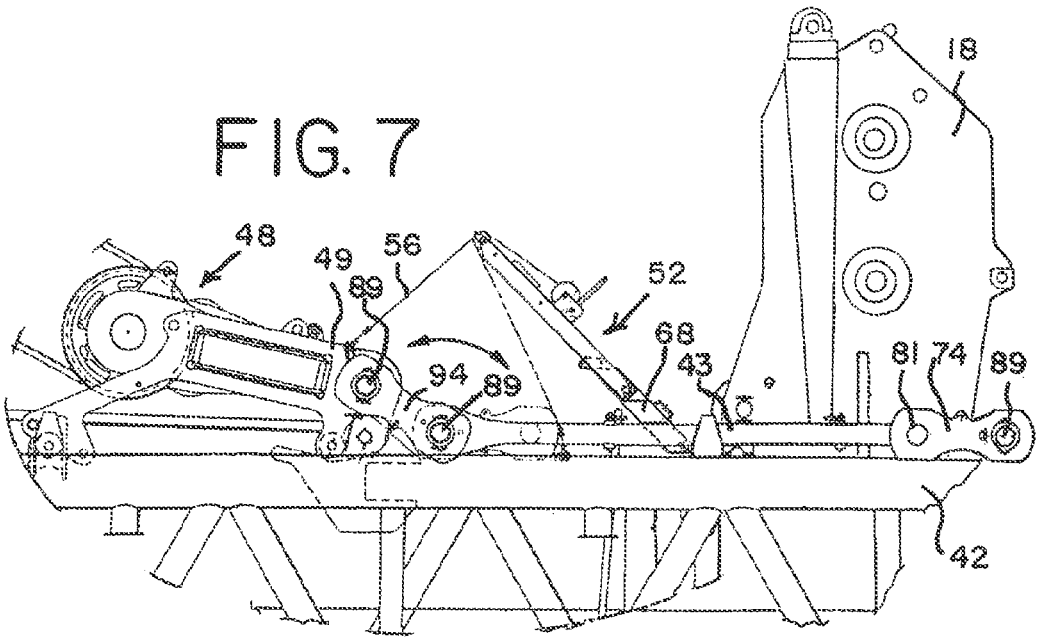
FIG. 7 is side elevational view of the part of the boom of FIG. 6 showing the preferred frame mounted winch assembly of the present invention, with a frame extension, being used to move the connector to a position where the connector is attached to the equalizer.

The preferred frame assembly 52 may also be used to connect the boom backstay strap to the upper equalizer 48, as shown in FIGS. 6 and 7. In this method the first section elongated member comprises a part of the boom backstay strap section, and the second section member comprises a part of a boom hoist equalizer 48, such as side plates 49 with holes there through. While most of the boom backstay sections are transported with a connector 74 on only one end, the section of boom backstay that is connected to the equalizer 48 may preferably have a connector 74 on one end, and a specially designed connector 94 on the other end, as seen in FIGS. 16-20. Like the other sections of boom backstay, this section is made from two elongated members 41 and 43. It is provided with bracket assemblies 95 used to hold the elongated members 41 and 43 at a fixed separated distance from each other. (These brackets, though not shown, are included on other strap sections 63, 64, 76 and 77.) The brackets 95 may also be used to lift the strap section onto or off of a boom section 42 if needed.

Like connector 74, special connector 94 has three link plates 96, 97 and 98. Just as with connector 74, in connector 94 a pin 89 extends through a first hole 91 in each of the three link plates and the holes in the heads of each of the elongated members 41 and 43, with the head of each elongated member sandwiched between two of the link plates of the connector 94. The link plates 96, 97, 98 each include an ear 82 with a hole, and the bar 57 is inserted through these holes so that the link plates of connector 94 are lifted simultaneously. However, connector 94 is provided with a special lift point provided by a bracket 99 welded onto the end of center link plate 97, as shown in FIGS. 18 and 19.

As shown in FIG. 7, when flipping connector 94 into its operational position, the frame 53 is attached to the elongated member 43 using a frame extension 68 attached between the frame 53 and the elongated member 43 to shift the working radius of the pulley 58 compared to the connector 94. The frame extension 68 is shown in detail in FIGS. 14 and 15. It includes a central body 79 and two end sections 72 and 73. The central body 79 is wider than the ends, providing support surfaces 69 and 71 on both sides of the central body. These support surfaces are at the same angle relative to the longitudinal axis of the frame extension 68 as the support surface 59 is to the longitudinal axis of the frame 53. Frame extension 68 includes a hole 75 and a hitch pin 78. The end section 73 is placed between the spaced side frame plates 61 and 62 of the frame 53, and hitch pin 66 is placed through the holes in the side frame plates 61 and 62 and through hole 75 to secure the frame extension 68 and the frame 53 together. The support surface 59 sits against the end of end section 73, and a beveled end of side frame plates 61 and 62 (best seen in FIG. 12) rest against support surface 69. The combined frame 53 and frame extension 68 is then placed with the end section 72 through the space between elongated members 41 and 43, and hitch pin 78 is put in place underneath the elongated members to hold the combined frame 53 and frame extension 68 in the position shown in FIG. 7. In this way, even when using the extension, the frame is attached to a section of the crane suspension assembly. The winch line 56 is then attached to lift point 99 and the winch 54 is used to lift the connector 94 up to a position where the center of gravity is over the pin 89. The connector 94 is then pushed to the left (from the view point of FIG. 7) and winch line 56 is let out until the connector 94 is in its second, operational position in which holes 93 in link plates 96, 97, 98 are in line with the holes on side plate members 49 of equalizer 48.

The extension frame 68 is stored on the wire rope guide 18 in the position shown in FIG. 6 when not in use. It is only used in handling special connector 94, in either the assembly or disassembly process, so it can be stored at this location where it is accessible when needed.

Figures 16, 17, 18, 19, 20:
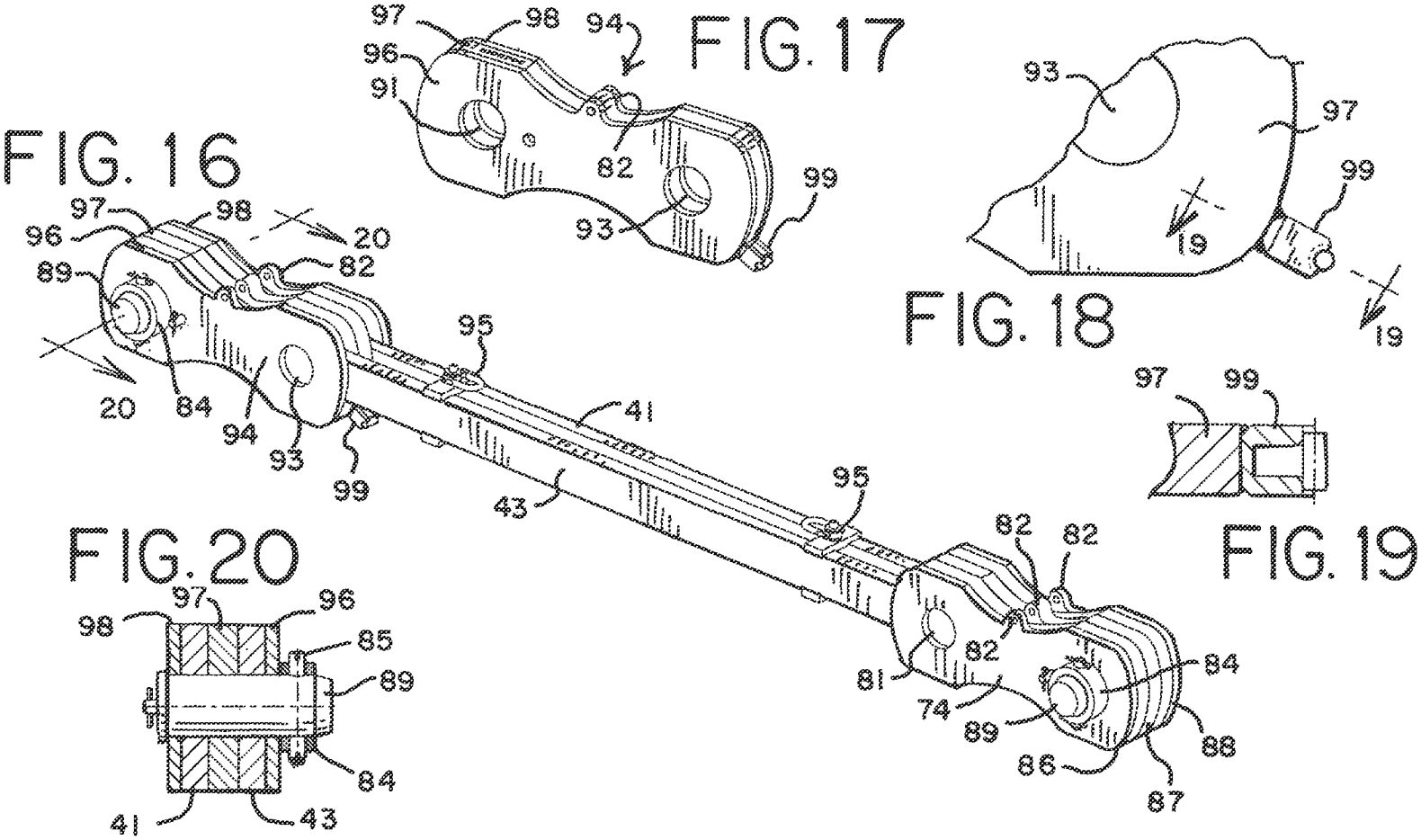
FIG. 16 is a perspective view of the boom backstay section shown in FIGS. 6 and 7.
FIG. 17 is a perspective view of the connector shown in FIGS. 6-7 and on the boom backstay section of FIG. 16, with all three of its link plates right next to one another.
FIG. 18 is an enlarged partial side view of the lift point attachment of the connector of FIG. 17.
FIG. 19 is a cross-sectional view taken along line 19-19 of FIG. 18.
FIG. 20 is a cross-sectional view taken along line 20-20 of FIG. 16.

FIG. 20 shows the cross section of a pin 89 though link plates and elongated members. A collar 84 is used on one end of pin 89, held on by a locking pin 85 with cotter pins through both ends. The collar 84 provides uniform clamping force to uniformly hold the link plates together, and is preferred since the link plates rotate about the pin 89 as they are connected and disconnected, and thus the orientation of locking pin 85 with respect to the orientation of the link plates will vary at each connection.

The preferred winch 54 includes an automatic load holding brake, such as the model KX15500101 Fulton brand hand operated brake winch from Cequent Performance Products, Inc., Bloomfield Hills, Mich. This model includes a self-activating automatic brake that holds the load securely when the crank handle is released. Alternatively the winch could be hydraulically operated, electrically operated or pneumatically operated.

Figure 21:
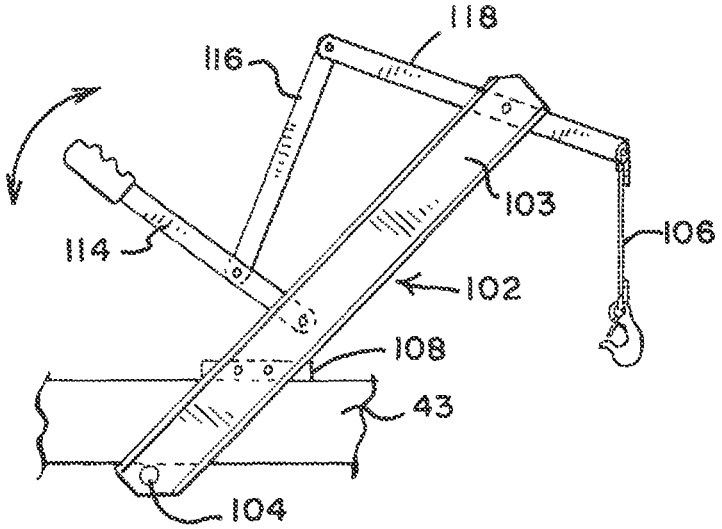
FIG. 21 is a side view of a first alternate frame mounted assembly of the present invention.

Rather than a using a winch, an alternate frame assembly 102 uses a lever 114, such as shown in FIG. 21. In this embodiment, the lever 114 is mounted on a frame 103, and the tension member 106 is moved by operation of the lever 114. The lever could be directly connected to the tension member 106 or, as shown in FIG. 21, additional linkage 116 and 118 can be used so that the position of the lever 114 is at a comfortable position for handling by the assembly worker. In either case the lever and its connection to the frame and tension member should provide a mechanical advantage, so that less force is needed to pull down on the lever than would be required to lift the link plates directly by hand. Of course the use of a lever adds the benefit that a downward force, which is easier for a worker to generate than an upward force, is needed to lift the connector. The tension member 106 in this embodiment can be a wire rope, a fiber rope, a chain, a fixed length bar and combinations thereof. Of course the winch line 56, while preferably being a wire rope, could also be a fiber rope or chain, and a short fixed length bar could be attached to the otherwise flexible line that winds on spool 55.

The frame 103 of frame assembly 102 connects to the elongated member 43 just like the frame assembly 52 connects, using a fixed support surface 108 and a hitch pin 104. However, other mounting features could be used on the frame of the frame assemblies of the present invention to allow the frame to be removably attached at a desired working orientation to one of the sections of the suspension. For example, one of the side frame plates 61 and 62 could have a section removed from it below the support surface 59 so that the frame 53 could be placed onto the elongated member 43 by being brought in from the side rather than down from above. In that case the hitch pin 66 could be replaced by a lower support surface that was permanently attached to the lower part of the frame.

Figure 22:
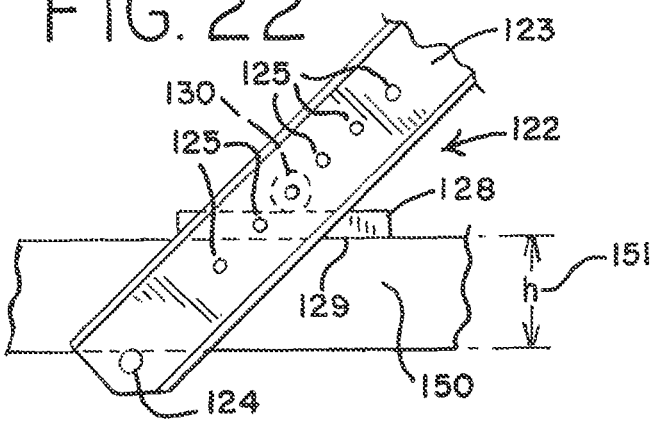
FIG. 22 is a side view of a second alternate frame mounted assembly of the present invention.
Figure 23:
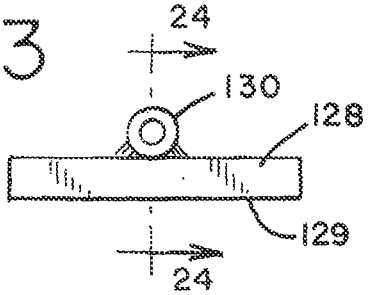
FIG. 23 is a detailed side view of a swivel link plate used to provide the support surface in the frame mounted assembly of FIG. 22.
Figure 24:
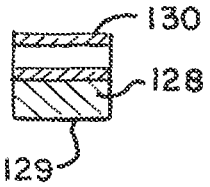
FIG. 24 is a cross-sectional view taken along line 24-24 of FIG. 23.

Also, the mounting features may allow the frame to be mounted on elongated members of different heights. In this way, the same frame assembly could be used for assembling different cranes, which often have suspension sections of different cross-sectional dimensions. For example, as seen in frame assembly 122 shown in FIGS. 22-24, at least one of i) the support surface 129 and ii) the shaft 124, is attached to the frame 123 in a fashion that allows the longitudinal distance between the support surface 129 and the shaft 124 to be adjusted. In the frame assembly 122 the support surface 129 on plate 128 is attached to the frame in a fashion that allows the plate 128 to be moved between different fastening points on the frame 123, by being bolted between holes 125 spaced along the length of the frame 123. If the frame 123 is to be attached to an elongated member 150 having a greater height 151, the plate 128 is attached to the frame by using one of the bolt holes 125 higher up on the frame 123.

In the frame assembly 122 the support surface 129 is mounted to the frame 123 so that it can pivot with respect to its mounting on the frame. The support plate 128 is welded to a hollow tubular member 130, and the bolt holding the plate 128 to the frame 123 passes through the tubular member 130. This pivotal mounting assures that no matter the height of the elongated member 150, the support surface 129 will always be flat against the elongated member 150.

Figures 25, 26, 27:
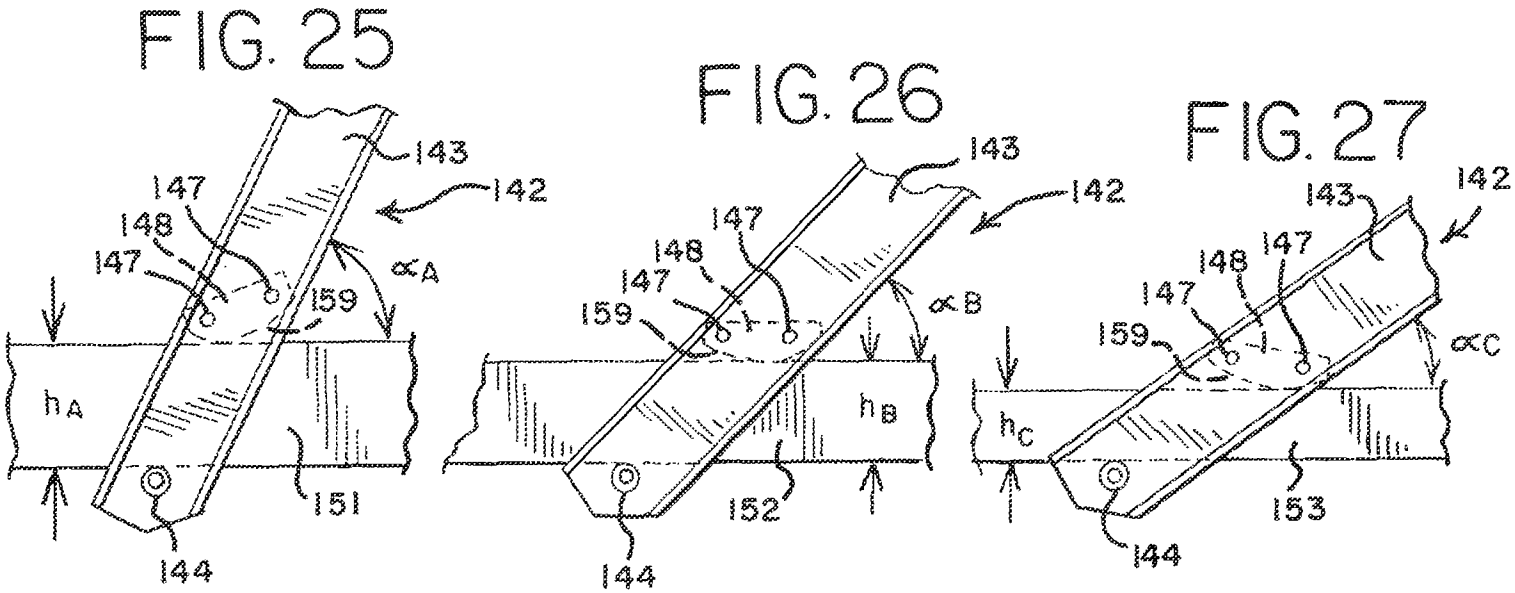
FIGS. 25-27 are side views of a third alternate frame mounted assembly of the present invention, mounted on three different crane suspension assembly sections with different heights.

A different mounting feature is used on frame assembly 142, shown in FIGS. 25-27, to allow it to be mounted on elongated members 151, 152 and 153 of different heights. In this embodiment, the frame mounted assembly is built with a support block 148 that has support surface 159 with a convex shape. Even though the support block 148 in this case is mounted to the frame 143 in a fixed position by bolts 147, and the hitch pin 144 is secured at only one possible position, the convex shape of support surface 159 assures that the contact of the support surface 159 to the elongated member 151, 152 or 153 of different heights will always be at a relatively smooth part of the surface 159, rather than at a corner of a support plate. As seen in FIG. 25, when the elongated member 151 has a relatively great height $h_A$, the rear part of support surface 159 rests on the elongated member 151, resulting in a steep angle $\alpha_A$ between the frame 143 and the elongated member 151. As seen in FIG. 26, when the elongated member 152 has a medium height $h_A$, the middle part of support surface 159 rests on the elongated member 152, resulting in a medium angle $\alpha_B$ between the frame 143 and the elongated member 152. And when the elongated member 153 has a relatively small height $h_C$, as seen in FIG. 27, when the front part of support surface 159 rests on the elongated member 153, resulting in a shallow angle $\alpha_C$ between the frame 143 and the elongated member 153.

It should be understood that various changes and modifications to the presently preferred embodiments described herein will be apparent to those skilled in the art. Instead of two separate plates 60 with a spacer 65 between them, the support surface 59 could be provided by a single plate on only one of the frame side plates. Or extending the complete distance between the side frame plates. Rather than using a pulley, the winch 54 could be mounted up high enough on frame 53 that the line 56 corning off the winch could be directly connected to the lifting point on the connector 74. Such changes and modifications can be made without departing from the spirit and scope of the present invention and without diminishing its intended advantages. It is therefore intended that such changes and modifications be covered by the appended claims.

The invention claimed is:

1. A method of connecting first and second sections of a crane suspension assembly together, wherein at least the first section comprises at least one elongated member having a head at an end thereof, the head including a hole there through perpendicular to the axis of elongation of the elongated member; and wherein the second section comprises a member with a hole there through; and further wherein a connector is pivotally connected to the head of the first section elongated member by a first pin extending through a first hole in the connector and the hole in the head of the first section elongated member, the method comprising:

a) attaching a frame to one of the first and second sections;

b) connecting a tension member between the frame and the connector;

c) moving the tension member so that the connector pivots about the first pin from a first position to a second position where a second hole in the connector is in alignment with the hole in the second section member;

d) putting a second pin through the second hole in the connector and the hole through the second section member; and e) disconnecting the tension member from the connector.

2. The method of claim 1 wherein the first and second sections of the crane suspension assembly each comprise a boom backstay strap section.

3. The method of claim 1 wherein the first and second sections of the crane suspension assembly each comprise a jib backstay strap section.

4. The method of claim 1 wherein the first and second sections of the crane suspension assembly each comprise a plurality of elongated members.

5. The method of claim 4 wherein the first and second sections of the crane suspension assembly each comprise two elongated members.

6. The method of claim 1 wherein the connector comprises a plurality of link plates that sandwich the head of an elongated member between them.

7. The method of claim 1 wherein the connector comprises three link plates and the first and second sections of the crane suspension assembly each comprise two elongated members, and the first pin extends through a first hole in each of the three link plates and the holes in the heads of each of the elongated members of the first section, with the head of each elongated member sandwiched between two of the link plates of the connector.

8. The method of claim 1 wherein a lever is mounted on the frame, and the tension member is moved by operation of the lever.

9. The method of claim 1 wherein the step of moving the tension member to pivot the connector comprises:

a) pivoting the connector and thereby raising the connector's center of gravity to a position where the connector's center of gravity is approximately directly above the first pin;

b) moving the connector to where gravity causes the connector to want to fall to the connector's second position; and c) moving the tension member in a controlled manner to lower the connector to the second position.

10. The method of claim 1 wherein the frame comprises two spaced side frame plates with a support surface attached to at least one of the side frame plates and located between the side frame plates, and the frame is attached to one of the first and second sections by placing the frame over the elongated member of the first section with the support surface resting on the elongated member and the two spaced side frame plates on either side of the elongated member, and inserting a pin between the two spaced side frame plates below the elongated member.

11. The method of claim 1 wherein the second section member also comprises at least one elongated member, and the frame is attached to the second section elongated member.

12. The method of claim 1 wherein the first section elongated member comprises a part of the boom backstay strap section, and the second section member comprises a part of a boom hoist equalizer.

13. The method of claim 1 wherein the tension member is selected from the group consisting of a wire rope, a fiber rope, a chain, a fixed length bar and combinations thereof.

14. The method of claim 1 wherein a winch is mounted on the frame, the tension member comprises a flexible line, and the tension member is moved by winding the line onto and off of the winch.

15. The method of claim 14 wherein the winch is selected from the group consisting of hand operated winches, hydraulically operated winches, electrically operated winches and pneumatically operated winches.

16. The method of claim 14 wherein the winch line includes a hook and the link plates of the connector each include an ear with a hole there through, and the hook is attached to a bar inserted though the holes of the connector ears to move the connector link plates simultaneously.

17. The method of claim 14 wherein the winch comprises an automatic load holding brake.

18. The method of claim 14 wherein the frame further supports a pulley, and the line extends from the winch and is trained over the pulley before being connected to the connector.

19. The method of claim 18 wherein the frame is attached to the first section elongated member using a frame extension attached between the frame and the elongated member to shift the working radius of the pulley compared to the connector.

20. A method of moving a connector used to connect sections of a crane suspension assembly about a pivot axis from a first position to a second position during crane assembly or disassembly comprising:

a) attaching a frame with a winch mounted thereon to a section of the crane suspension assembly;

b) connecting a line from the winch to a lift point on the connector, the connector having a center of gravity;

c) activating the winch to move the connector so that the connector pivots about the pivot axis;

d) securing the connector in the connector's second position; and e) disconnecting the winch line from the connector.

21. The method of claim 20 wherein the step of activating the winch to move the connector comprises:

a) pivoting the connector about a first pin defining the pivot axis and thereby raising the center of gravity of the connector to a position where the center of gravity is approximately directly above the first pin;

b) moving the connector further to where gravity causes the connector to want to fall to the connector's second position; and c) letting the line out from the winch in a controlled manner to lower the connector to the second position.

22. The method of claim 21 wherein the step of activating the winch to move the connector further comprises: d) holding the connector in the second position while a second pin is inserted.

23. The method of claim 21 wherein the frame is attached to the section of the crane suspension assembly at a point such that the line of action of the winch line is through the lift point and the pivot axis when the center of gravity of the connector is directly above the first pin.

24. The method of claim 21 wherein, when the crane is being assembled, the frame is attached to the section of the crane suspension assembly at a point such that when the line of action of the winch line is through the lift point and the pivot axis, the center of gravity of the connector will be in a position such that the weight of the connector can produce sufficient moment to overcome frictional forces in the pivot axis and allow the connector to travel to the connector's second position.

* * * * *